US011849893B2

(12) United States Patent
Ruffo

(10) Patent No.: US 11,849,893 B2
(45) Date of Patent: Dec. 26, 2023

(54) FLOOR WASHING-DRYING MACHINE

(71) Applicant: FIMAP S.P.A., Fraz. Santa Maria (IT)

(72) Inventor: Massimiliano Ruffo, Verona (IT)

(73) Assignee: FIMAP S.P.A., Santa Maria (IT)

( * ) Notice: Subject to any disclaimer, the term of this patent is extended or adjusted under 35 U.S.C. 154(b) by 617 days.

(21) Appl. No.: 17/054,972

(22) PCT Filed: May 6, 2019

(86) PCT No.: PCT/EP2019/061499
§ 371 (c)(1),
(2) Date: Nov. 12, 2020

(87) PCT Pub. No.: WO2019/219422
PCT Pub. Date: Nov. 21, 2019

(65) Prior Publication Data

US 2021/0228049 A1 Jul. 29, 2021

(30) Foreign Application Priority Data

May 15, 2018 (IT) ..... 102018000005370

(51) Int. Cl.
*A47L 11/40* (2006.01)
*A47L 11/30* (2006.01)

(52) U.S. Cl.
CPC ..... *A47L 11/4044* (2013.01); *A47L 11/305* (2013.01); *A47L 11/4077* (2013.01); *A47L 11/4016* (2013.01); *A47L 11/4061* (2013.01)

(58) Field of Classification Search
CPC ..... A47L 11/4044; A47L 11/305; A47L 11/4077; A47L 11/4016; A47L 11/4061
See application file for complete search history.

(56) References Cited

U.S. PATENT DOCUMENTS 4,158,901 A 6/1979 Johnson et al.
5,265,300 A 11/1993 O'Hara et al.
2006/0282975 A1 12/2006 Basham et al.

FOREIGN PATENT DOCUMENTS

CN 102271567 A 12/2011
EP 0662301 A1 7/1995
(Continued)

OTHER PUBLICATIONS

International Search Report dated Jul. 2, 2019 re: Application No. PCT/EP2019/061499, pp. 1-4, citing: U.S. Pat. No. 4,158,901 A, EP 0 662 301 A1, U.S. Pat. No. 5,265,300 A and GB 1 338 011 A.
(Continued)

*Primary Examiner* — David Redding
(74) *Attorney, Agent, or Firm* — CANTOR COLBURN LLP

(57) ABSTRACT

A floor washing-drying machine includes a framework, which can move on the floor and supports, in a lower region, a floor washing assembly having at least one rotating brush and at least one nozzle for dispensing a washing liquid. A floor drying assembly is arranged at the rear of the washing assembly, which includes a rear floor wiper, which extends substantially transversely to the advancement direction of the machine, and a suction device which is connected to a tank for recovering the dirty liquid. The machine further includes at least one pair of lateral floor wipers, which are arranged on mutually opposite sides with respect to the vertical central plane of the framework and extend substantially along at least one portion of the longitudinal extension of the framework; each one of the lateral floor wipers includes respectively at least three vertical drying blades.

5 Claims, 9 Drawing Sheets

(56) References Cited

FOREIGN PATENT DOCUMENTS

| | | | |
|---|---|---|---|
| GB | 1338011 | A | 11/1973 |
| JP | 2011120681 | A | 6/2011 |
| JP | 2012245171 | A | 12/2012 |
| WO | 2013123271 | A1 | 8/2013 |

OTHER PUBLICATIONS

IT Search Report dated Jan. 29, 2019 re: Application No. IT 201800005370, pp. 1-7, citing: U.S. Pat. No. 4,158,901 A, EP 0 662 301 A1, U.S. Pat. No. 5,265,300 A and GB 1 338 011 A.
Written Opinion dated Jul. 2, 2019 re: Application No. PCT/EP2019/061499, pp. 1-5, citing: U.S. Pat. 4,158,901 A.

FLOOR WASHING-DRYING MACHINE

TECHNICAL FIELD

The present disclosure relates to a floor washing-drying machine.

BACKGROUND

Floor washing-drying machines are known which allow to wash the floor by dispensing washing liquids and dry the floor with collection of the dirty liquid, after the action of cleaning brushes.

These machines, which in the background art can be of the "onboard operator" type or of the "walk behind" type, have, in general, a framework which is movable on the floor, provided in a lower region with a washing assembly, which, between a pair of lateral splash guards, comprises rotating brushes, which perform a scrubbing action on the floor, and dispensing nozzles, fed by a washing liquid tank, arranged on the framework of the machine.

To the rear of the washing assembly, according to the advancement direction of the machine, a drying assembly is furthermore supported by the machine framework and is constituted by a floor wiper, which extends transversely to the advancement direction of the machine and has a pair of rubber blades, which slide on the floor and are arranged parallel and mutually spaced, in order to allow, together with a suction device, to collect and suck the dirty liquid, which is sent to a recovery tank, also arranged on the framework of the machine, so as to leave the floor dry and clean.

In practice, while working, during the advancement of the machine on the floor, the portion of floor affected by the passage of the machine, known as washing track, is subjected, at the front, to the cleaning action produced by the rotating brushes and by the washing liquid dispensed by the dispensing nozzles and, at the rear, where there is a mixture of removed dirt and residue of washing liquid, to the drying action of the floor wiper, which with the suction device creates a partial vacuum region which allows the suction of the dirt and its delivery to the recovery tank.

The lateral splash guards prevent, at the same time, the rotation of the rotating brushes from being able to spray the washing liquid outside of the lateral perimeter of the machine and therefore of the washing track.

One drawback that is observed in floor washing-drying machines is caused by an inappropriate covering of the wet surface of the floor by the drying assembly.

In particular, during the steering phase of the machine, it is observed that a region of the washing track is not dried. This region can be more or less wide, depending on the configuration or type of the machine.

This drawback, which can be found both in walk-behind machines and in on-board operator machines, forces the operator to a further cleaning pass, with a corresponding increase in costs concerning energy consumption and washing liquid consumption and time necessary for completion of work.

Although in order to try and solve or at least limit this drawback, adapted measures have been introduced in modern floor washing-drying machines, such as the possibility of oscillation of the floor wiper about a vertical axis or contoured splash guards, external to the rotating brushes, the presence of a significant region of the washing track that is not dried during the steering phase is a still-existing problem.

SUMMARY

The aim of the present disclosure is to provide a floor washing-drying machine that is capable of improving one or more of the above mentioned aspects of the background art.

Within this aim, the disclosure devises a floor washing-drying machine capable of ensuring optimum drying of the floor even during the steering maneuvers of the machine.

Moreover, the present disclosure overcomes the drawbacks of the background art in a manner that is alternative to any existing solutions.

The disclosure further provides a floor washing-drying machine which, due to its particular constructive characteristics, is capable of giving the greatest assurances of reliability in use and is furthermore competitive also from a purely economic standpoint.

This aim and these and other advantages that will become better apparent hereinafter are achieved by providing a floor washing-drying machine according to the independent claim, optionally provided with one or more of the characteristics of the dependent claims.

BRIEF DESCRIPTION OF THE DRAWINGS

Further characteristics and advantages of the disclosure will become better apparent from the description of a preferred but not exclusive embodiment of the machine according to the disclosure, illustrated by way of non-limiting example in the accompanying drawings, wherein.

DETAILED DESCRIPTION OF THE DRAWINGS

Figure 1:
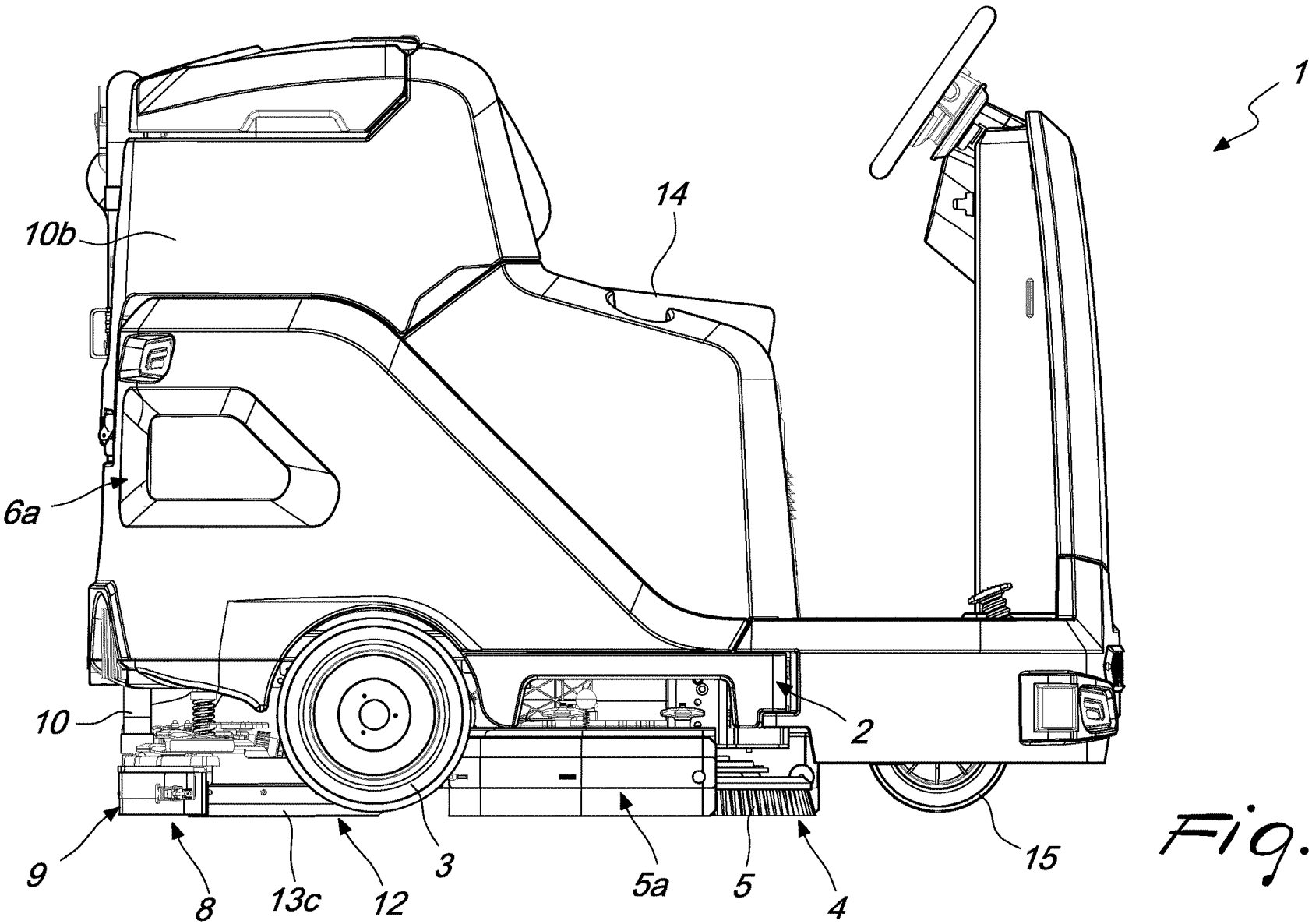
FIG. 1 is a lateral elevation view of the machine according to the disclosure.
Figure 2:
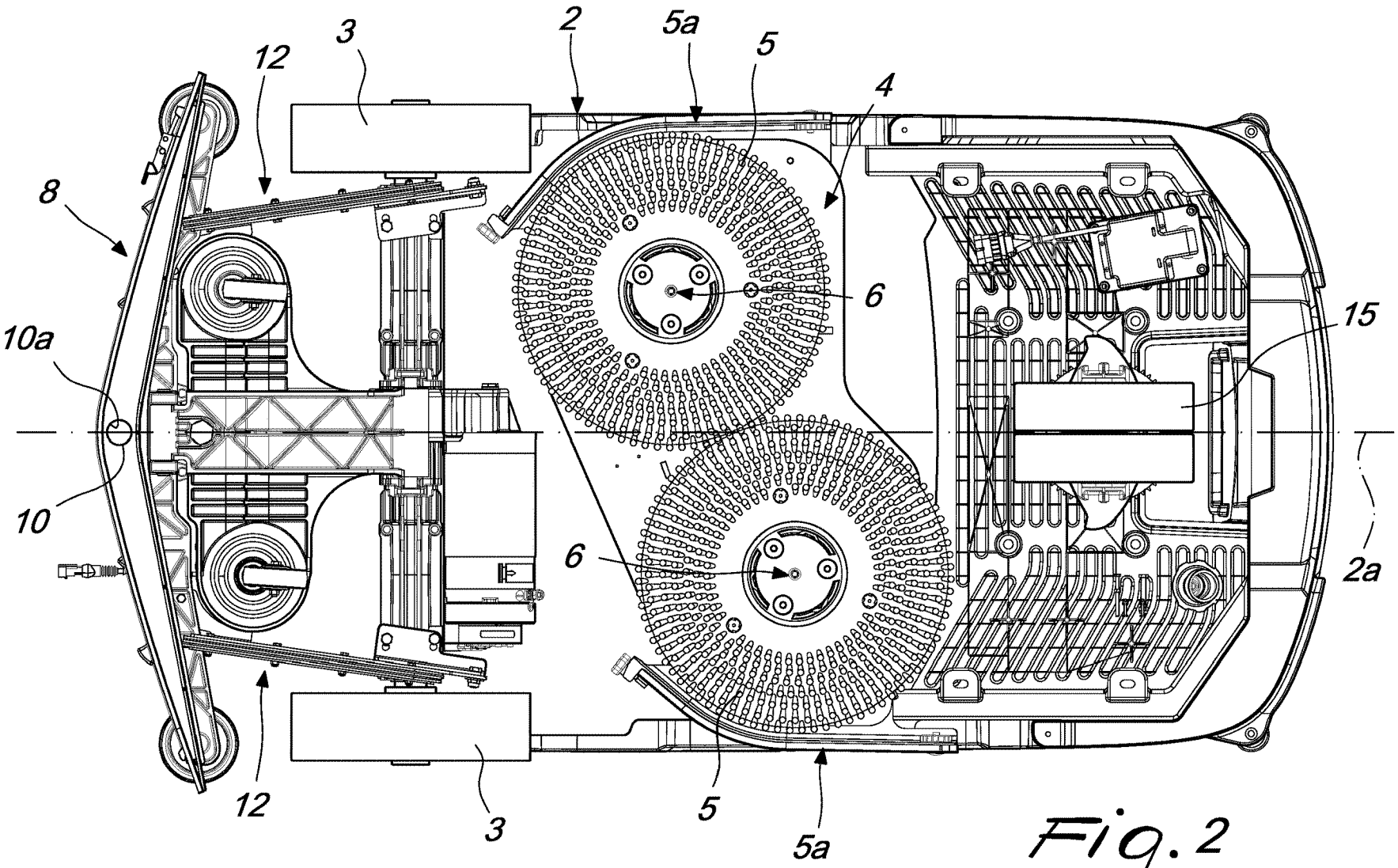
FIG. 2 is a bottom view of the machine according to the disclosure.
Figure 3:
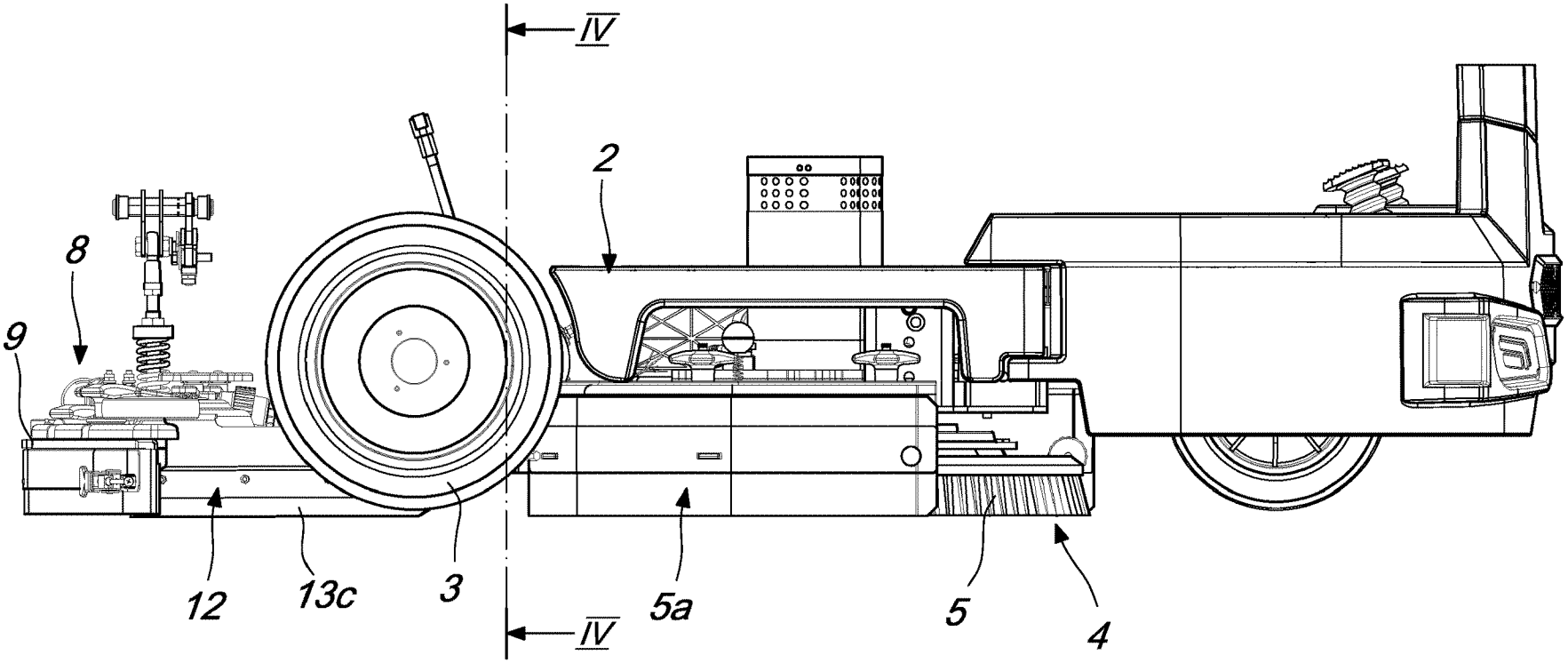
FIG. 3 is a side view of the machine according to the disclosure with parts omitted for the sake of simplicity.
Figure 4:
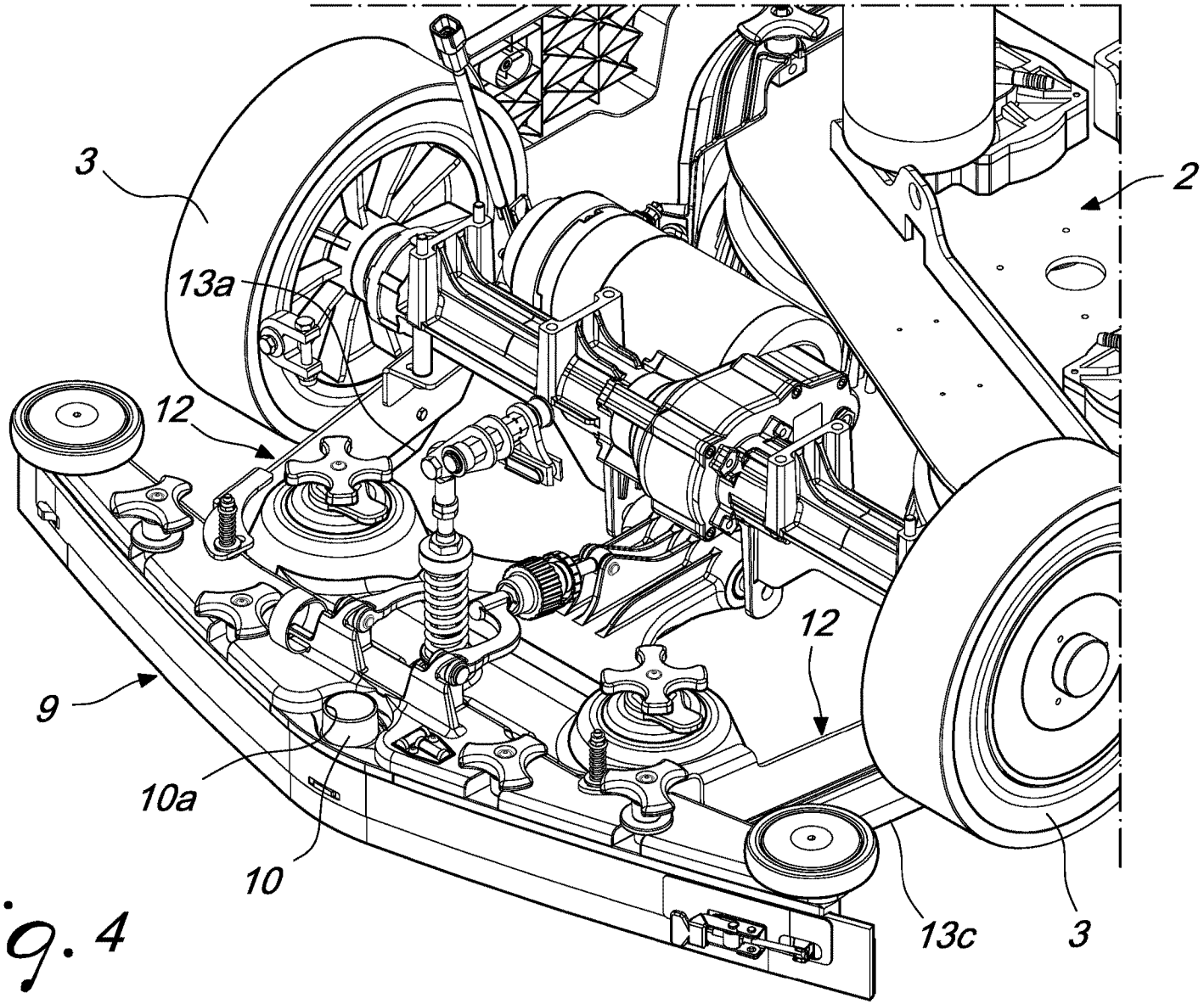
FIG. 4 is a top perspective view of the machine according to the disclosure, with parts omitted for the sake of simplicity.
Figure 5:
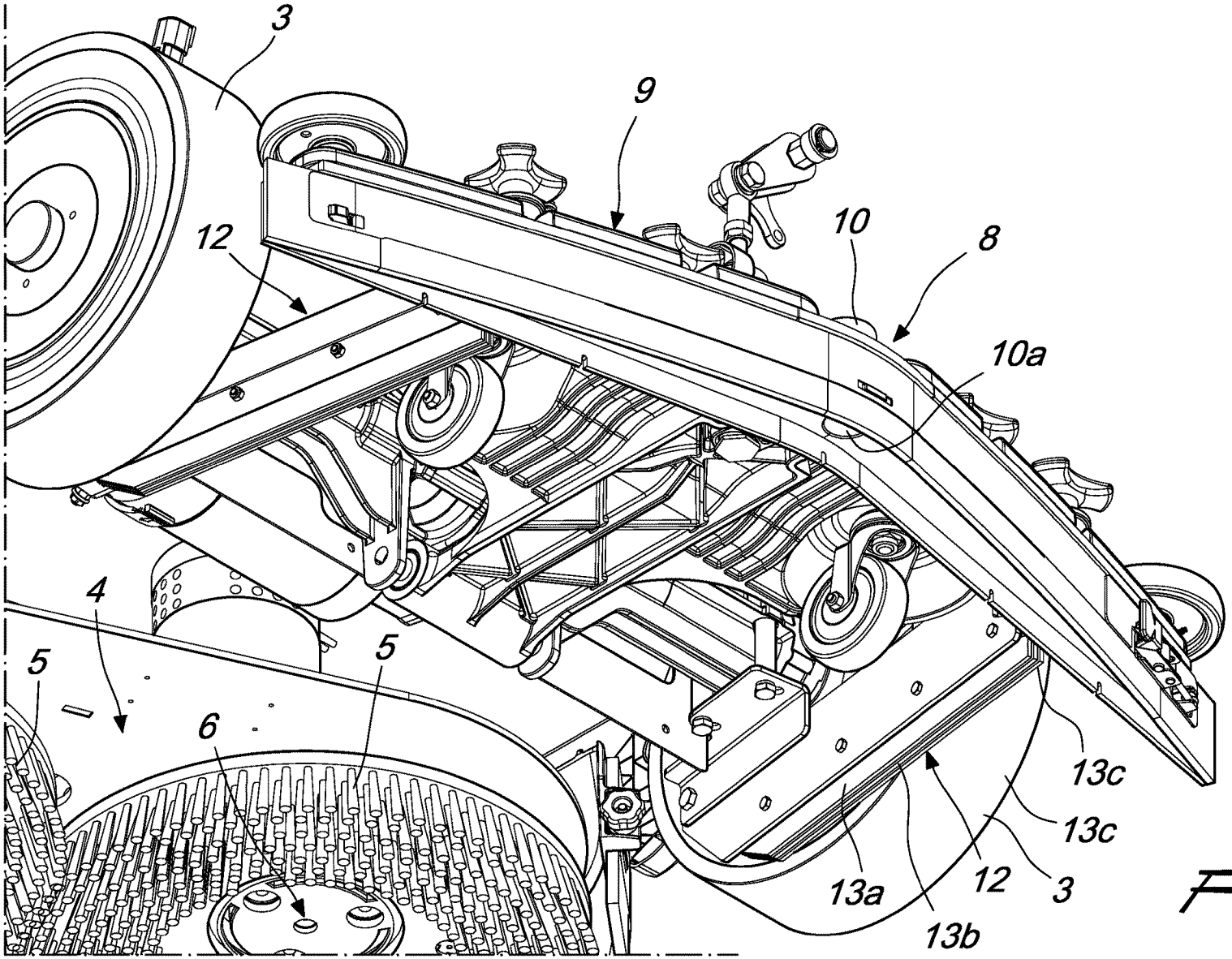
FIG. 5 is a bottom perspective view of the machine according to the disclosure, with parts omitted for the sake of simplicity.
Figure 6:
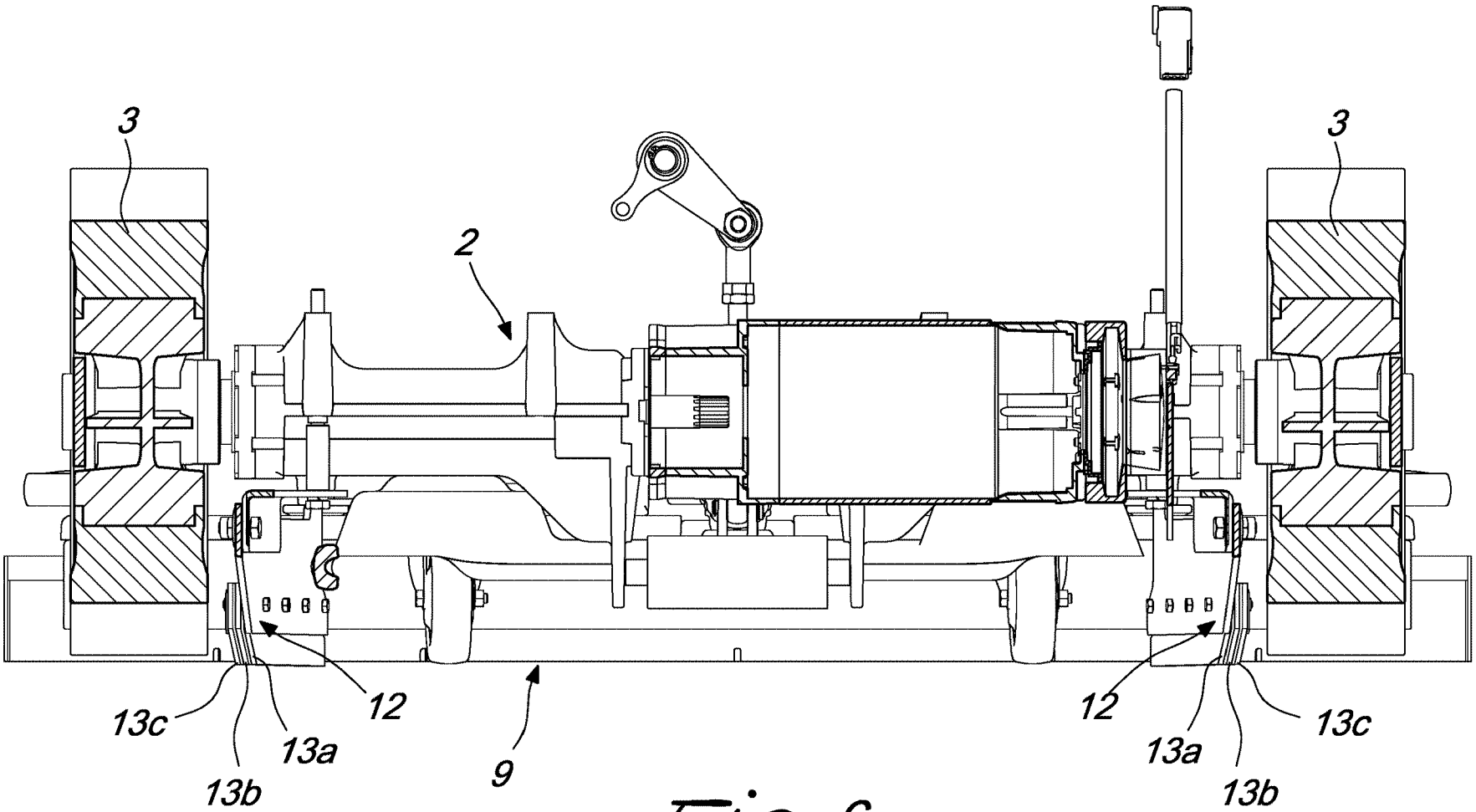
FIG. 6 is a sectional view taken along the line VI-VI of FIG. 3.
Figure 7:
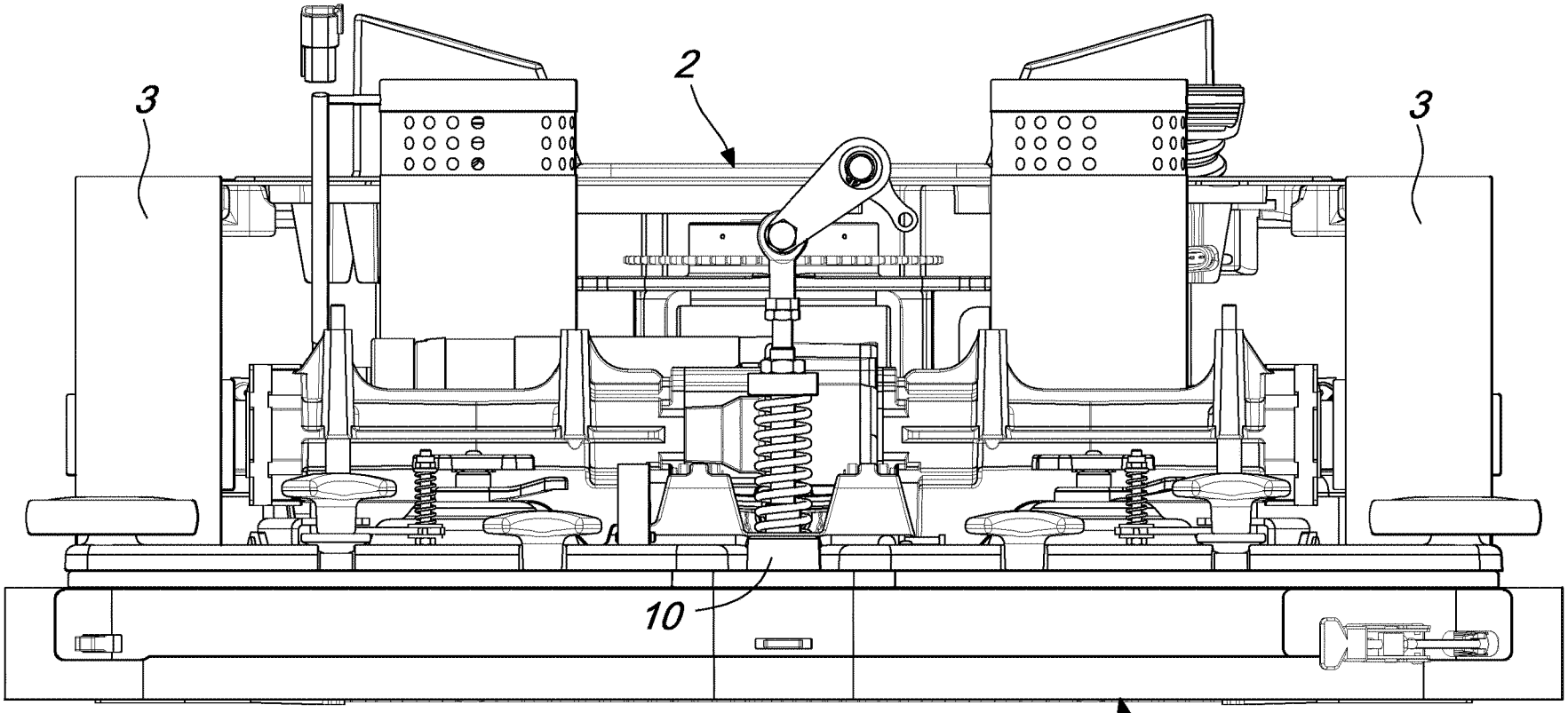
FIG. 7 is a head-on rear view of the machine according to the disclosure, with parts omitted for the sake of simplicity.

With reference to the above cited figures, the machine according to the disclosure, generally designated by the reference numeral 1, comprises a framework 2, which can move on the floor, to which at least two lateral wheels 3 are advantageously connected, allowing the resting of the framework 2 on the floor, and can be connected to automated traction motor means of the machine.

The framework 2 has, parallel to the direction of advancement of the machine, a longitudinal extension and supports in a lower region a floor washing assembly 4, which comprises one or more rotating brushes 5 and at least one nozzle 6 for dispensing a washing liquid, which draws from a supply tank 6*a* arranged on the framework 2.

Optionally, laterally to the brushes 5 there can be splash guards 5*a*, which are meant to prevent the washing liquid propelled, by centrifugal force, by the brushes 5 from being able to exit laterally, with respect to the advancement direction of the machine, from the perimeter of the framework 2.

At the rear of the washing assembly 4, according to the advancement direction of the machine on the floor, there is a floor drying assembly 8, which comprises a rear floor wiper 9, which extends substantially transversely to the advancement direction of the machine, and a suction device 10, which comprises a suction inlet 10*a* and is connected to a tank 10*b* for recovering the dirty liquid, which is also mounted on the framework 2.

The machine according to the disclosure comprises at least one pair of lateral floor wipers 12, which are arranged, on mutually opposite sides, with respect to the vertical central plane 2*a* of the framework 2, which extends parallel to its advancement direction, and extend substantially along at least one portion of the longitudinal extension of the framework 2.

Also according to the disclosure, each lateral floor wiper 12 is provided with at least three respective drying blades 13*a*, 13*b*, 13*c*, which are made of elastically flexible material and are in contact with the floor with their lower edge.

In particular, the drying blades 13*a*, 13*b*, 13*c* are arranged substantially parallel and laterally spaced with respect to each other, and are constituted respectively, from the inside toward the outside of the framework 2 in a transverse direction with respect to the advancement direction of the machine, by at least one first rough drying blade 13*a*, by at least one second fine drying blade 13*b*, and by at least one third drying finishing blade 13*c*.

In practice, due to their arrangement, the three drying blades 13*a*, 13*b*, 13*c* are subjected, particularly during the steering movements of the machine, to a movement on the floor that allows them to carry out, one after the other, in sequence, different actions on said floor.

In particular, as mentioned above, the first blade 13*a* performs a rough drying function on the floor, since it entrains the larger particles of dirt and most of the liquid present on the floor, while the second blade 13*b* performs a "fine" drying function, since it acts on the remaining particles of dirt of smaller sizes and entrains, thus causing it to be further reduced, the quantity of residual liquid on the floor.

Finally, the third blade 13*c* carries out the drying "finishing" function, since it completes the drying process by acting on the last remaining residues that have remained and have not been cleaned by the first and the second blade 13*a* and 13*b*, which preceded it in the drying action.

Conveniently, the lateral floor wipers 12 extend between the brushes 5 and the rear floor wiper 9 and are advantageously arranged in a space comprised between the two lateral wheels 3 of the framework 2.

Preferably, the lateral floor wipers 12 extend, moreover, progressively away from the vertical central plane 2*a* of the framework 2 proceeding from the rear part toward the front part of the framework 2.

It should be noted that the machine according to the disclosure may be of the "on-board operator" type, as in the illustrated example, and in this case the framework 2 has, in the front part, a driver seat 14 and, besides the lateral wheels 3, arranged in the rear portion, at least one frontal steerable wheel 15, or it may be of the "walk-behind" type and in this case the framework 2 will have an entrainment handlebar, in the rear part, and a single pair of lateral wheels 3 for resting on the ground.

Figure 8:
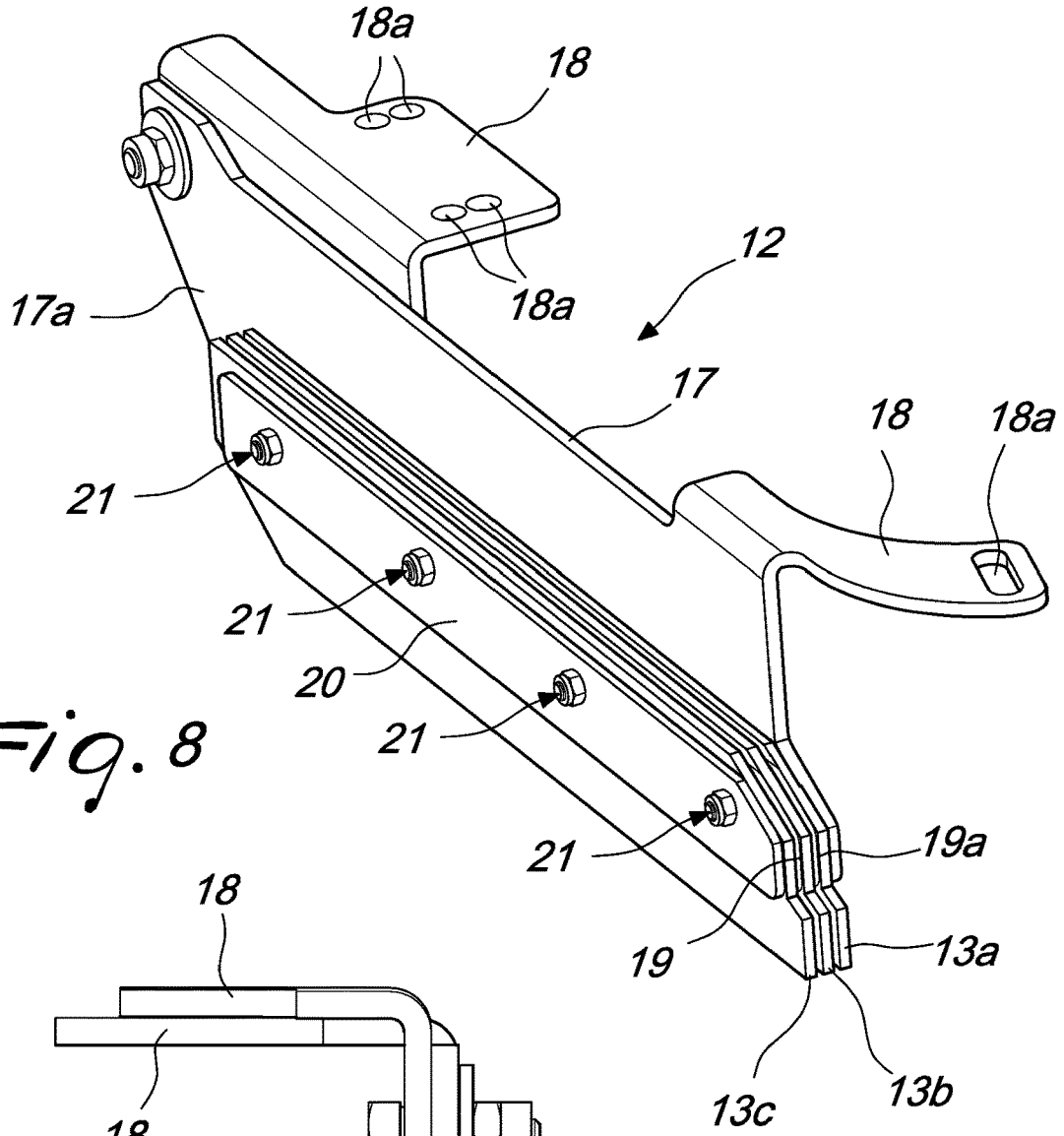
FIG. 8 is a perspective view of a lateral floor wiper of the machine according to the disclosure.
Figure 9:
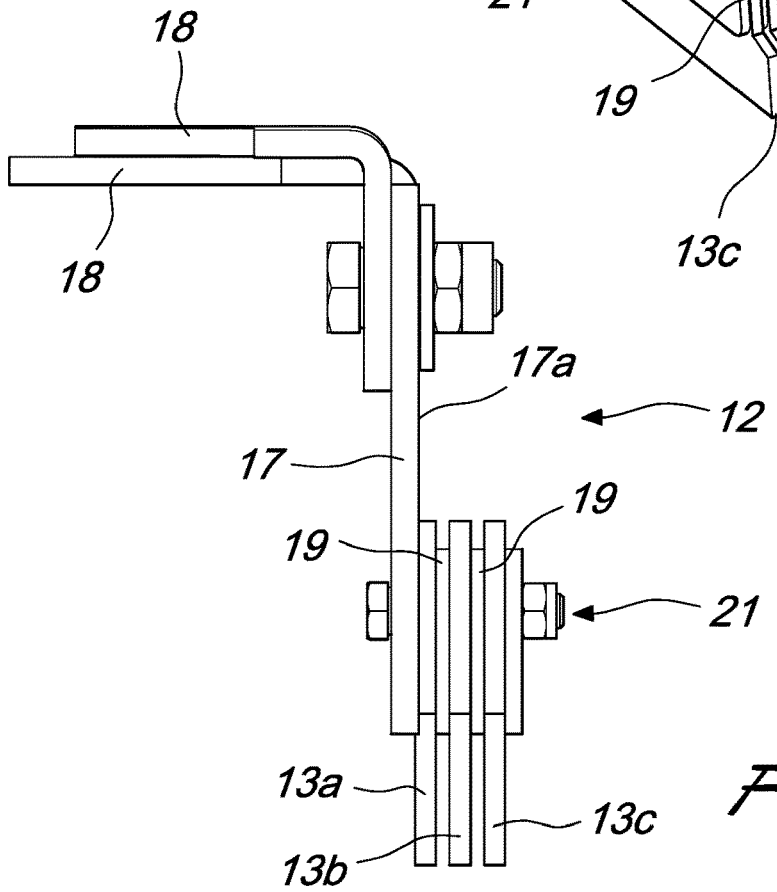
FIG. 9 is a front view of a lateral floor wiper of the machine according to the disclosure.

With reference, in particular, to FIGS. 8 and 9, each one of the lateral floor wipers 12 can be conveniently provided by means of a supporting frame 17 provided advantageously with means for connection to the lower part of the framework 2, constituted conveniently by brackets 18 provided with openings 18*a* for the passage of anchoring bolts.

In particular, the supporting frame 17 has at least one abutment face 17*a*, which is conveniently oriented laterally with respect to the advancement direction of the machine and, more particularly, in the embodiment illustrated, toward the outside of the framework 2.

The drying blades 13*a*, 13*b*, 13*c* are arranged parallel to said abutment face 17*a* of the supporting frame 17 and are clamped, with the interposition of spacer elements 19 between them, between a lateral presser body 20, constituted, for example, by a strip arranged parallel to the supporting frame 17, and the abutment face 17*a*, by means of locking bolts and screws 21.

The operation of the machine, according to the disclosure, is as follows.

During the advancement of the machine, the brushes 5 scrub the floor, while the dispensing nozzle 6 applies the washing liquid on the floor. The continuation of the advancement of the machine makes the lateral floor wipers 12 and the rear floor wiper 9 collect the washing liquid and the removed dirt, which are subsequently recovered by the suction device 10.

Figure 10:
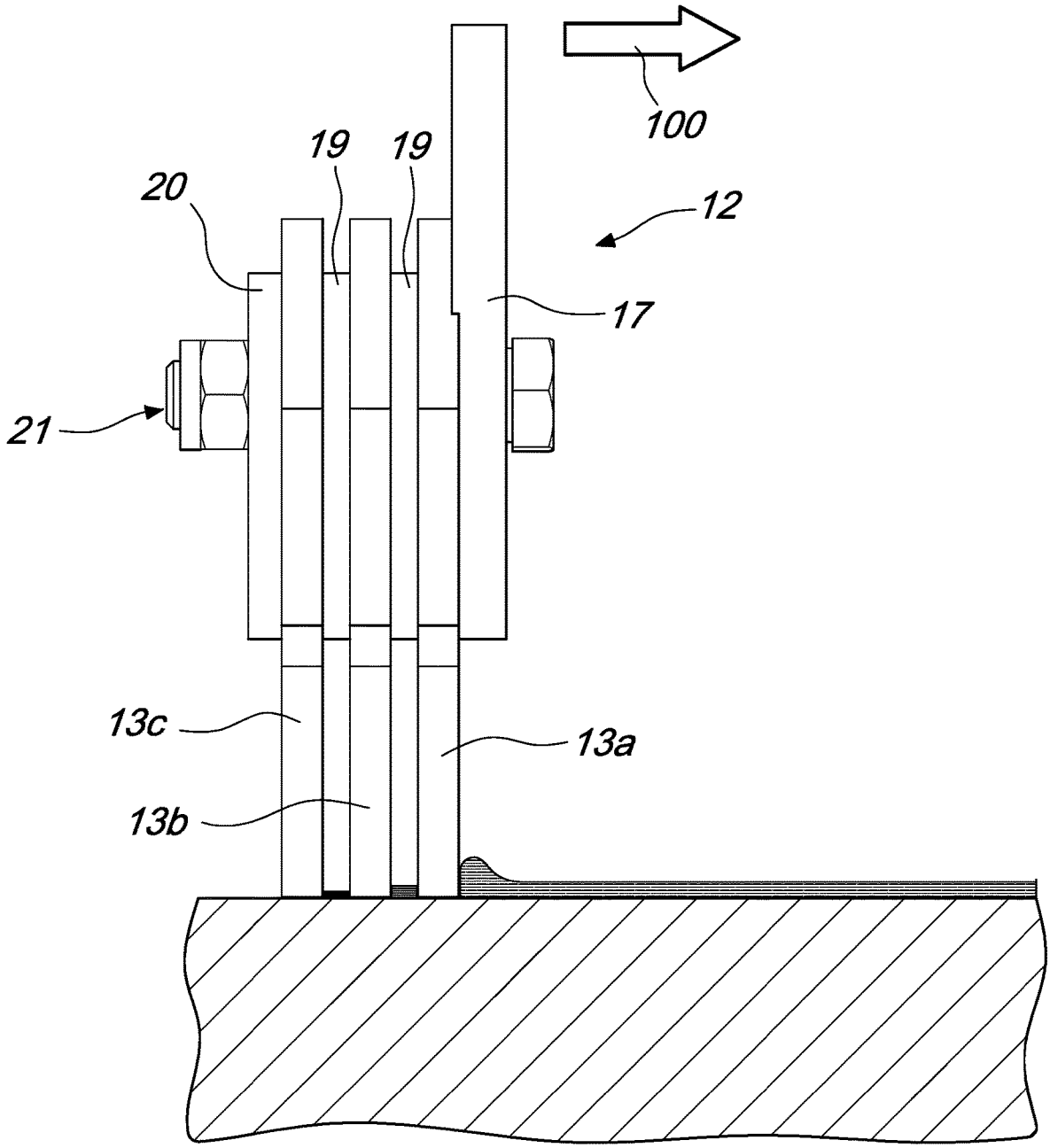
FIG. 10 is a side view of a lateral floor wiper of the machine according to the disclosure during operation.

In particular, as can be seen in FIG. 10, in case of a steering action of the machine in its advancement, one of the lateral floor wipers 12 performs a movement on the floor according to the movement direction designated by the arrow 100, depending on whether the steering occurs to the right or to the left. This movement brings, in each instance, the lateral floor wipers 12 to entrain with them the dirt and the residue of washing liquid present on the floor in lateral areas, otherwise not covered by the passage of the rear floor wiper 9.

More particularly, the movement of the floor wipers 12 during the steering actions of the machine, respectively in case of steering actions to the right or to the left, allows the corresponding first blade 13*a* to perform a rough drying, i.e., the entrainment of the larger particles of dirt and of the greater quantity of liquid present on the floor, allows the second blade 13*b* to carry out the fine drying, i.e., the entrainment of the smaller particles and the further reduction of liquid residual, and allows the third blade 13*c* to carry out the finishing of the drying, i.e., the entrainment of any last residues of dirt and liquid that might have remained, thus ensuring completion of the drying process.

In practice it has been found that the disclosure achieves the intended aim and objects, providing a floor washing-drying machine capable of ensuring a complete and optimum drying of the floor during the passage of the machine, even in the event of steering actions.

The disclosure, thus conceived, is susceptible of numerous modifications and variations, all of which are within the scope of the appended claims.

Thus, for example, based on the same concept, depending on the geometry and type of the machine, on the finishing requirements and costs, the lateral floor wipers may be optionally positioned also in other areas of the framework, but in any case always so as to allow the coverage of the whole wet area during the movement of the machine.

All the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102018000005370 from which this application claims priority are incorporated herein by reference.

The invention claimed is:

1. A floor washing-drying machine comprising: a framework configured to move on the floor and supports, in a lower region, a floor washing assembly, comprising at least one rotating brush and at least one nozzle for dispensing a washing liquid, a floor drying assembly being arranged at a rear of said washing assembly, which comprises a rear floor wiper, which extends substantially transversely to an advancement direction of the machine, and a suction device connected to a tank for recovering the dirty liquid, and further comprising at least one pair of lateral floor wipers arranged on mutually opposite sides, with respect to a vertical central plane of said framework which is parallel to the machine advancement direction, and extending substantially along at least one portion of a longitudinal extension of said framework, each one of said lateral floor wipers comprising at least three respective vertical drying blades, made of elastically flexible material, in contact with a lower edge thereof against the floor and arranged substantially parallel and laterally spaced with respect to each other, said vertical drying blades comprising respectively, from an inside toward an outside of said framework in a transverse direction with respect to the advancement direction of the machine, at least one first rough drying blade, at least one second fine drying blade and at least one third drying finishing blade.

2. The machine according to claim 1, wherein said lateral floor wipers extend between said at least one brush and said rear floor wiper.

3. The machine according to claim 1, wherein said lateral floor wipers are arranged in a space comprised between a pair of lateral wheels for resting on the floor for said framework.

4. The machine according to claim 1, wherein said lateral floor wipers extend progressively away from the vertical central plane of said framework proceeding from a rear part toward a front part of said framework.

5. The machine according to claim 1, wherein each one of said lateral floor wipers comprises a supporting frame provided with means for connection to a lower part of said framework and provided with at least one abutment face which is oriented laterally with respect to the longitudinal extension of said framework, said drying blades being arranged parallel to said abutment face and being clamped, with the interposition between said drying blades of spacer elements, between a lateral presser body and said abutment face.

* * * * *